United States Patent [19]

Fabianic

[11] 3,967,995

[45] July 6, 1976

[54] JACKETED BOTTLE AND METHODS OF MAKING SAME

[75] Inventor: William L. Fabianic, Alton, Ill.

[73] Assignee: Liberty Glass Company, Sapulpa, Okla.

[22] Filed: Aug. 1, 1974

[21] Appl. No.: 493,785

Related U.S. Application Data

[63] Continuation-in-part of Ser. No. 255,992, May 23, 1972, abandoned.

[52] U.S. Cl. ..... 156/86; 53/14; 53/30 S; 156/83; 156/198; 156/213; 156/214; 156/215; 156/293; 206/497; 215/12 R; 264/DIG. 74

[51] Int. Cl.[2] ..... B29C 27/20

[58] Field of Search ..... 156/84, 85, 86, 83, 156/303.1, 293, 294, 198, 213, 214, 215, 325; 264/230, 342 R, DIG. 71; 215/12 R; 206/497; 53/30 S, 14

[56] References Cited

UNITED STATES PATENTS

| | | | |
|---|---|---|---|
| 1,329,696 | 2/1920 | Blackstone | 156/86 |
| 2,029,131 | 1/1936 | Shoemaker | 156/86 |
| 2,647,816 | 8/1953 | Battista | 156/86 |
| 3,604,584 | 6/1969 | Shank, Jr. | 156/86 |
| 3,655,469 | 4/1972 | Huron | 156/86 |

FOREIGN PATENTS OR APPLICATIONS

| | | | |
|---|---|---|---|
| 879,203 | 10/1961 | United Kingdom | 156/86 |

*Primary Examiner*—Edward G. Whitby
*Attorney, Agent, or Firm*—Koenig, Senniger, Powers and Leavitt

[57] ABSTRACT

A glass bottle having a body and a neck with a peripheral shoulder at the upper end of the body, and a paper jacket covering the bottle extending from above the shoulder at least to the heel of the bottle (where the wall of the body of the bottle merges with the bottom of the bottle) and covering the shoulder and body down to the heel to protect the bottle from weakening abrasion and scratches, and to contain fragments of the bottle in the event the bottle breaks. The jacket is constituted of waterproof paper, and may be secured in place on the bottle without any adhesive by shrinking. It may also be applied by means of an adhesive which is water-insoluble so that the bottle may be washed. In either case, the jacket may be preformed to such shape that it may be dropped on a bottle.

4 Claims, 9 Drawing Figures

JACKETED BOTTLE AND METHODS OF MAKING SAME

CROSS-REFERENCE TO RELATED APPLICATION

This application is a continuation-in-part of my copending application Ser. No. 255,992, filed May 23, 1972, now abandoned.

BACKGROUND OF THE INVENTION

This method relates to jacketed bottles and methods of making same, and more particularly to the provision of a glass bottle for beverages with a jacket for protecting it from abrasion and scratches, and for containing fragments of the bottle if it should break either from outside impact or inside pressure.

The invention applies principally to non-returnable beverage bottles, but is also equally applicable to returnable bottles.

It is well known in the glass bottle art that glass bottles (and other glass products) have great strength when new and unmarred, but that this initial high strength is frequently reduced more than 50% on account of scratches on the surface that may be too small to be detected by eye. When the glass of the bottle or container has been subjected to abrasions or scratches, the strength of the bottle is so reduced that the bottle breaks more easily from internal pressure or impact. In event of the breaking of the bottle, the glass is frequently shattered, and fragments are scattered. The scattering of the sharp fragments of glass frequently occasions physical injuries.

The glass container industry has devoted very substantial efforts, first, to preserve the initial strength of the glass; and, second, to trap or contain flying fragments in event the container is broken. This has been done by many methods, such as strengthening the bottles by ion exchange, etching, annealing, steam treatment, tempering or toughening, pyrolyzing of metallic oxides, application of many types of coatings to the outer surface, both transparent and opaque, including all kinds of waxes, stearates, silicates and many types of plastics. These coatings range from a very thin film to an appreciable thickness, and the machinery required in the use and application of these methods necessitates heavy capital investment, skilled operators, and carefully controlled operations, as well as high operating expenses.

SUMMARY OF THE INVENTION

Among the several objects of this invention may be noted the provision of a method of providing improved and simplified means for preserving the initial strength of a bottle which also functions to contain fragments of the bottle in the event it should shatter for any reason; the provision of a method of providing such means which enables the use of lighter weight bottles than heretofore used for a given quantity or content, the lighter weight bottle having as much effective strength as heavier weight bottles now in use; the provision of such means which may carry decoration and which may be pre-decorated at much less expense than decoration of a method of providing the bottle by other means; the provision of a method of providing such means which enables packaging of the bottles for handling and for shipment in cartons of convenient size, but without the expense of partitions in the cartons to protect the bottles in the carton from abrading or scratching one another; and the provision of a method of providing such means which enables recycling of the bottles.

In general, the method of this invention involves the provision of a glass bottle with a jacket of waterproof paper extending from above the shoulder of the bottle to the bottom of the bottle protecting the bottle from bottle-weakening abrasion and scratches, and being of such tensile strength as to contain within itself fragments of the bottle in the event the bottle should break either by impact from the outside or excessive pressure inside, the jacket being pre-formed, dropped on a bottle, humidified and dried.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENTS

Figure 1:
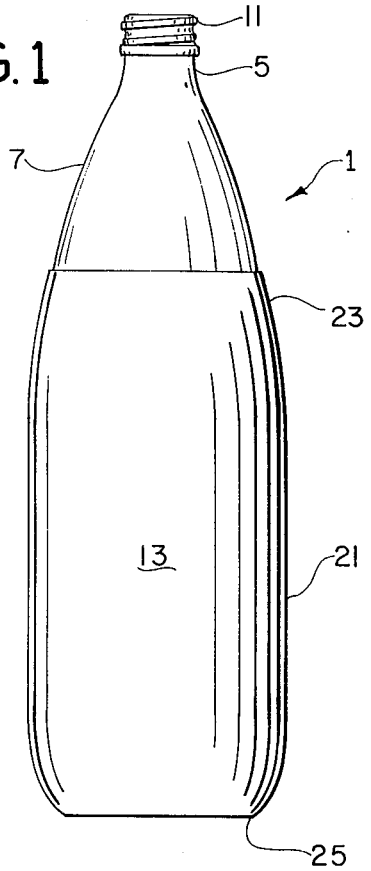
FIG. 1 is an elevation of a glass bottle provided with a jacket.
Figure 2:
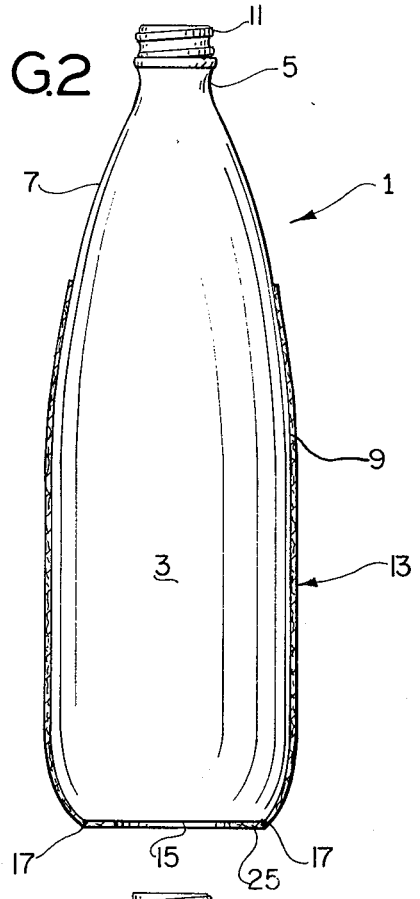
FIG. 2 is a view similar to FIG. 1 with the jacket shown in section.
Figure 3:
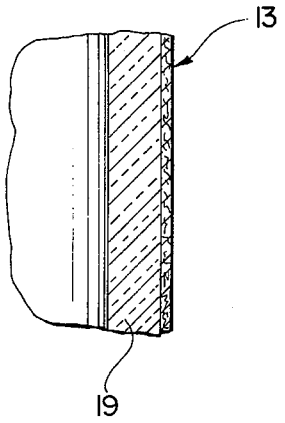
FIG. 3 is an enlarged fragmentary section through the wall of the bottle and the jacket.

Referring first to FIGS. 1–4, there is generally indicated at 1 a glass bottle having a cylindrical body 3 and a neck 5 with a transition 7 convergent from a peripheral shoulder 9 at the upper end of the body 3 to the neck. The neck has the usual finish 11, herein shown as a screw-thread finish for a screw cap (not shown). At 13 is indicated a jacket constituted by a layer of waterproof paper covering the bottle, extending from well above the shoulder 9 of the bottle to the bottom 15 of the body 3 of the bottle and covering the lower portion of the transition 7, the shoulder 9, the body 3 and the heel 17 of the bottle where the cylindrical wall 19 of the body of the bottle merges with the bottom 15. The jacket 13 has a cylindrical body portion 21 covering the body 3 of the bottle, an upper convergent portion 23 covering at least the lower part of the transition 7 and the shoulder 9, and a lower portion 25 covering the heel 17 and extending under the bottom 15 of the bottle. It is of sufficient thickness to protect all of the bottle which it covers, including the shoulder, the body and the heel of the bottle, from bottle-weakening abrasion and scratches, such as might otherwise result from contact with other bottles, or machine handling (e.g., handling in washing, filling and packaging machines). It is also of sufficient tensile strength to contain within itself fragments of the bottle in the event the bottle should break either by impact from the outside or excessive pressure inside.

The jacket 13 is formed of any suitable paper composition that will permit the bottle with the jacket thereon to be handled in washing, filling, packing or other machinery. It may be constituted of a cotton and linen type paper, or any solid bleached sulphate composition paper suitably waterproofed to withstand water encountered in any circumstances, including washing and other machine handling. A preferred paper is one generally having a caliper of 0.014 inch, a basic weight of 62 pounds plus or minus three pounds per one thousand square feet, and a brightness of 75 to 80. It has been found that a jacket made of such paper will accomplish the objects of the invention while being able to withstand usual changes in temperature, machine handling and washing of the bottles with caustics such as are frequently employed, and also that it is neither brittle nor of a frangible nature. In addition to its abrasion and scratch resisting functions, it also has such tensile strength as to contain fragments of the bottle if shattered either from outside impact or excessive inside pressure, thus preventing injury to persons in the vicinity at the time the bottle shatters.

Figure 4:
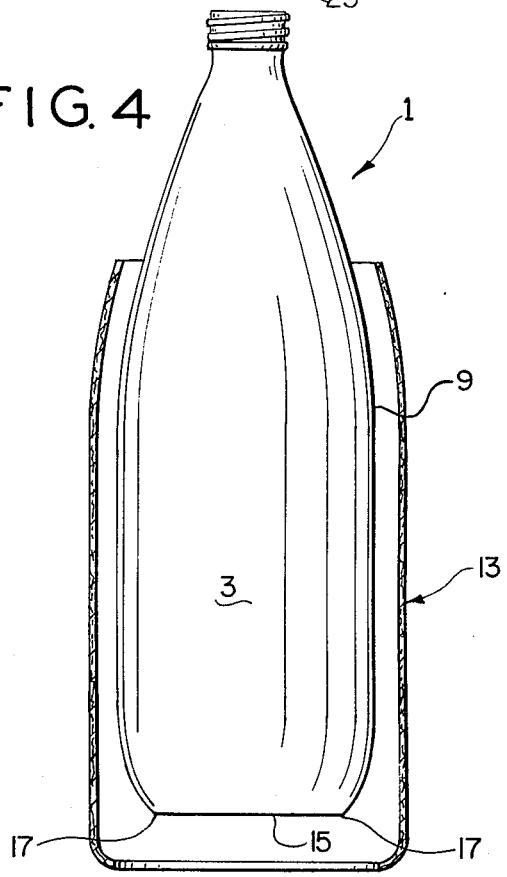
FIG. 4 is a view similar to FIG. 2 showing a step in a method of applying the FIG. 2 jacket.

As illustrated in FIG. 4, the jacket 13 is pre-formed of paper such as above described to the general shape of the bottle but very sightly larger than the bottle so that it may be loosely fitted around the bottle as shown in FIG. 4, being dimensioned to extend from above the shoulder 9 down to the bottom of the bottle to cover the shoulder 9, the body 3 and the heel 17. The preform is applied to the bottle as shown in FIG. 4. Then it is exposed to moist air, having a relative humidity of about 90%, for example, a temperature of 90°F. or higher causing absorption by the paper of about 10–12% by weight of water. After exposure to moist air the paper is dried, preferably in an oven at a temperature on the order of 220°F. On drying, the paper is reduced in water content to about 8% and shrinks tightly on the bottle and clings thereon sufficiently tightly so as not to shift in any ordinary use of the bottle, without the use of any adhesive.

Figure 5:
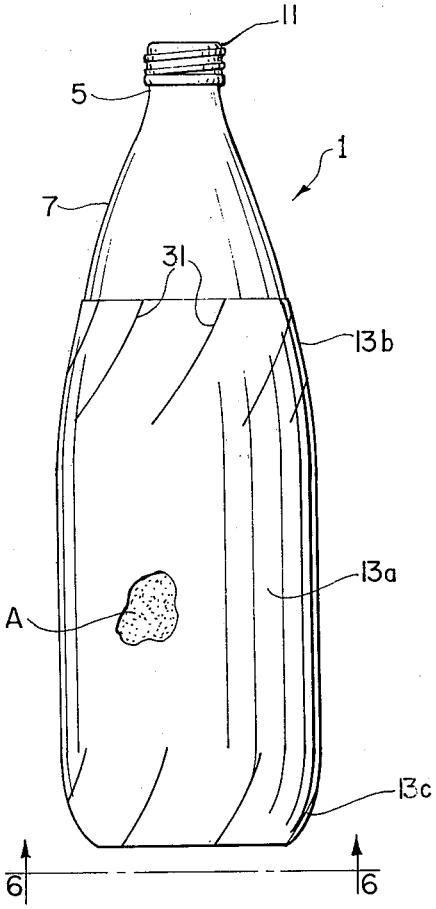
FIG. 5 is a elevation of a glass bottle provided with an alternative type of jacket.
Figure 6:
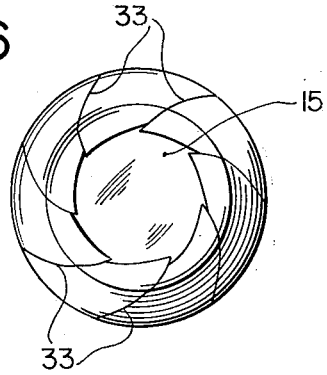
FIG. 6 is a bottom plan of FIG. 5.

FIGS. 5 and 6 show a modification in which the jacket, here designated 13*a*, is constituted by a sheet of paper wrapped around the bottle and adhered thereto by water-insoluble adhesive, e.g., an adhesive sold under the trade designation Polybond PA-350 by Polymer Industries, Inc., or any similar type satisfactory adhesive, such as indicated at A, with its upper margin 13*b* girdling the shoulder 9 and the lower portion of the transition 7, and its lower margin 13*c* girdling the heel of the bottle. Any other suitable water-insoluble adhesive may be used. The upper margin 13*b* is twisted in place on the portion of the bottle (the transition 7) above the shoulder as indicated at 31, and the lower margin 13*c* is twisted in place on the bottom of the bottle as indicated at 33 in FIG. 6, both of these margins being adhered in place by the water-insoluble adhesive A.

Figure 7:
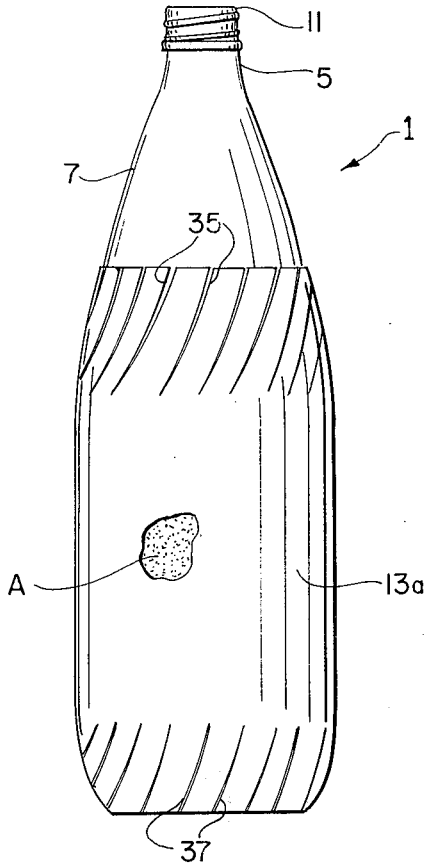
FIG. 7 is an elevation of a glass bottle provided with another alternative type of jacket.

FIG. 7 illustrates a modification of FIGS. 5 and 6 in which the upper and lower margins of the sheet 13*a* are slit as indicated at 35 and 37 to form in effect fringes at the upper and lower margins, these fringes being twisted in place on the transition and heel of the bottle.

A jacketed bottle as above described is not to be compared with bottles having ordinary paper labels, whether lithographed, printed or otherwise, that are simply wrapped around the bottle with a dab of mucilage or glue. Such paper labels will not withstand the caustic and washing necessary for the handling of beverage bottles, nor will any such flat label cover a sufficient area of the bottle itself to afford the protection that has been found necessary to preclude scratches or abrasions, from the heel up to well above the shoulder.

Figure 8:
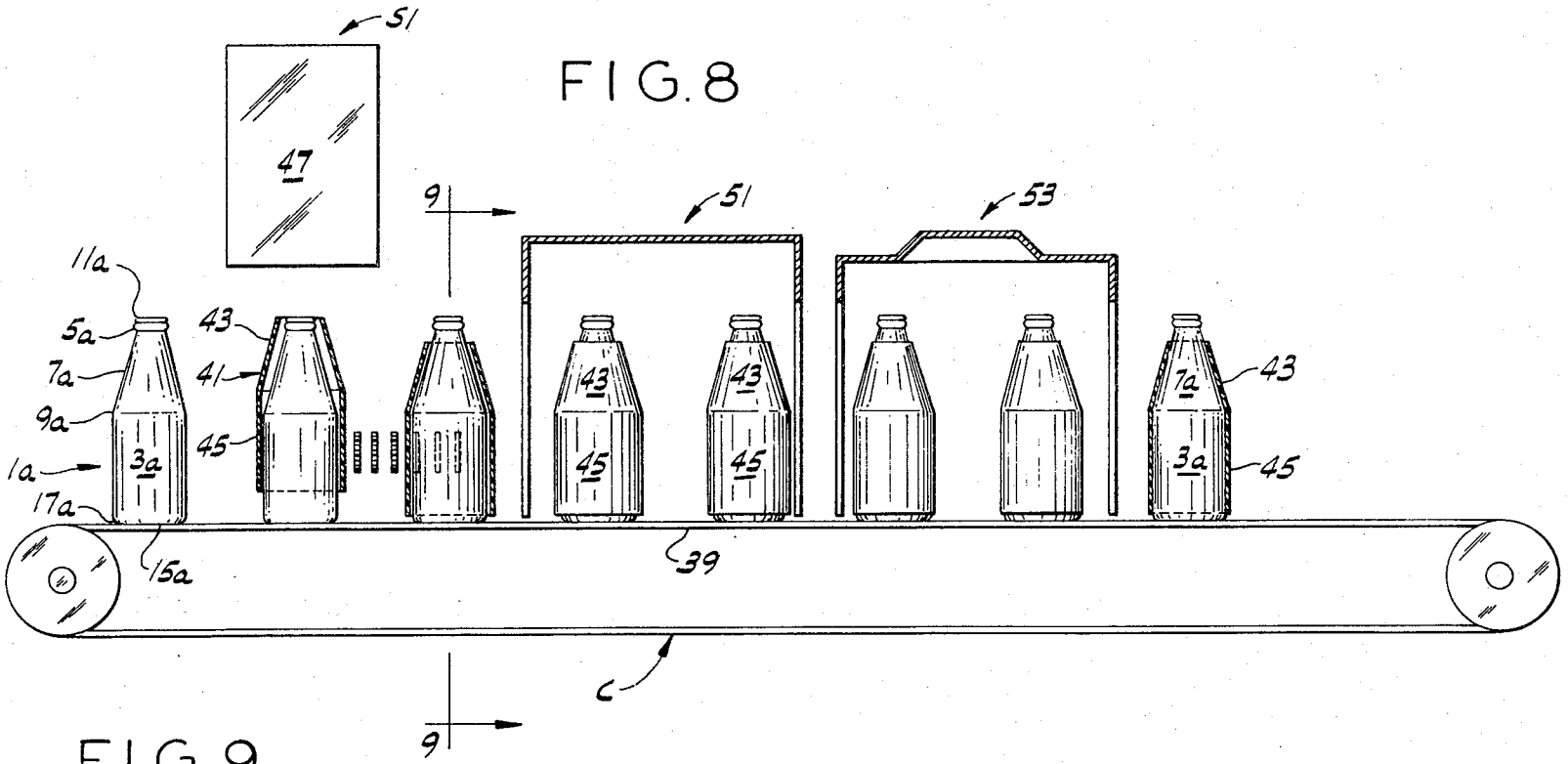
FIG. 8 is a view illustrating the method of this invention of applying jackets to bottles.
Figure 9:
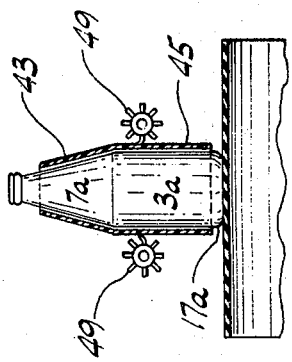
FIG. 9 is a section on line 9—9 of FIG. 8.

FIG. 8 shows the method of this invention for applying jackets to bottles, each bottle shown therein being of slightly different shape than the bottle 1 and designated 1*a* to distinguish it from the bottle 1. Each bottle 1*a* has a generally cylindrical body 3*a*, a neck 5*a*, and a generally conical portion 7*a* constituting a transition from the upper end of the body 3*a* to the neck 5*a*, with a shoulder 9*a* at the junction of the body 3*a* and the transition 7*a*. The finish of the bottle is designated 11*a*, the bottom 15*a* and the heel 17*a*. As shown in FIG. 8, bottles 1*a* are fed forward one after another in a predetermined horizontal path spaced at equal intervals, as by placing them in a standing position on the horizontal upper reach 39 of an endless conveyor C.

As each bottle moves forward, it passes a station S1 where a pre-formed paper jacket 41 is telescopically applied lower end first to the bottle by dropping the jacket on the bottle over its mouth end. The jacket has an upper generally conical portion 43 corresponding generally in shape to and slightly larger than the conical portion or transition 7*a* of the bottle and a generally cylindrical body portion 45 slightly larger than the body of the bottle. The conical portion 43 is open at its upper end and the cylindrical portion 45 is open at its lower end. The jacket preferably is about 1/32 – 1/64 inch larger than the bottle. A typical jacket would be formed of the bleached sulphate composition paper previously described. The jacket is dropped from a suitable jacket dispenser 47. After having been dropped down onto the bottle, the jacket is drawn down on the bottle as by means of rubber-fingered wheels such as indicated at 49 to the point where the conical upper end portion 43 of the jacket is nested on the conical upper end portion 7*a* of the bottle, surrounding and contiguous to the exterior surface of 7*a* and the cylindrical portion 45 of the jacket surrounds and is contiguous to the exterior surface of the cylindrical body 3*a* of the bottle, extending down to the heel 17*a* of the bottle, and being of the requisite height for this purpose.

The bottle with the snugged-down jacket thereon then passes through a humidifying zone 51 where it is subjected to a moist-air atmosphere of about 90% relative humidity at about 90°F., for example, causing absorption by the paper of about 10 – 12% by weight of water. Then the bottle with the humidified jacket thereon passes through a drying zone 53 where it is subjected to a temperature of 220°F., for example, to dry it, reducing its water content to about 8%, for example. The jacket shrinks tightly on the bottle and clings thereon as previously described.

The jacket 41 may be adhered to the bottle 1*a* by means of a water-insoluble adhesive instead of being shrunk on the bottle. The method of providing the jacket according to this embodiment would involve applying the adhesive to the bottle (as by spraying it on the bottle) before the bottle reached station S1, then dropping on the jacket 41 and drawing it down, omitting the humidifying at 51, and utilizing the heating at 53 to dry the adhesive.

In view of the above, it will be seen that the several objects of the invention are achieved and other advantageous results attained.

As various changes could be made in the above methods without departing from the scope of the invention, it is intended that all matter contained in the above description or shown in the accompanying drawings shall be interpreted as illustrative and not in a limiting sense.

What is claimed is:

1. The method of protecting glass bottles from bottle-weakening abrasion and scratches, each bottle having a body and a neck and a generally conical transition from the upper end of the body to the neck, with a shoulder at the junction of said body and said transition, said method comprising feeding forward bottles standing upright one after another in a predetermined generally horizontal path, placing a jacket on each bottle as it travels forward along said path, the jacket being a preformed paper jacket having an upper generally conical portion slightly larger than said generally conical transition of the bottle and a lower generally cylindrical body portion slightly larger than the body of the bottle, said conical portion of the jacket being open at its upper end and said cylindrical portion of the jacket being open at its lower end, the jacket being telescopically applied lower end first to the bottle over the upper end of the bottle and moving downwardly on the bottle to position the jacket with the conical portion of the jacket surrounding and contiguous to the exterior surface of the conical transition of the bottle and the cylindrical portion of the jacket surrounding and contiguous to the exterior surface of the body of the bottle, passing each bottle with a jacket thereon through a humidifying zone to humidify the entire jacket, and then passing each bottle with the humidified jacket thereon through a drying zone to dry the jacket and cause it to shrink on the bottle.

2. The method of claim 1 wherein the jacket is placed on the bottle by being dropped onto the bottle.

3. The method of claim 2 wherein the jacket, after having been dropped on the bottle, is drawn down on the bottle.

4. The method of claim 2 wherein, in the humidifying zone, the moisture content of the bottle is brought to about 10 – 12% by weight, and, in the drying zone, the moisture content is reduced to about 8%.

* * * * *